US006834482B2

(12) United States Patent
Collins, III

(10) Patent No.: US 6,834,482 B2
(45) Date of Patent: Dec. 28, 2004

(54) SWIVEL CHEEKED BRIDLE BIT

(76) Inventor: Thomas L. Collins, III, P.O. Box 69, Holbrook, AZ (US) 86025

( * ) Notice: Subject to any disclaimer, the term of this patent is extended or adjusted under 35 U.S.C. 154(b) by 0 days.

(21) Appl. No.: 10/410,259

(22) Filed: Apr. 10, 2003

(65) Prior Publication Data

US 2004/0200195 A1 Oct. 14, 2004

(51) Int. Cl.[7] ..... B68B 1/06
(52) U.S. Cl. ..... 54/8
(58) Field of Search ..... 54/7–9

(56) References Cited

U.S. PATENT DOCUMENTS

| | | | | |
|---|---|---|---|---|
| 345,592 | A | * 7/1886 | Hubner | 604/79 |
| 529,472 | A | 11/1894 | Bigelow | |
| 774,097 | A | * 11/1904 | Melleby | 54/7 |
| 962,134 | A | 6/1910 | Engle | |
| 3,205,636 | A | 9/1965 | Laningham | |
| 3,208,196 | A | 9/1965 | Ferguson | |
| 3,478,496 | A | * 11/1969 | Keough | 96/282 |
| 4,587,797 | A | 5/1986 | Conrad | |
| 4,884,390 | A | 12/1989 | Benjak et al. | |
| 4,941,312 | A | 7/1990 | Old, Sr. | |
| 5,062,255 | A | 11/1991 | Myler et al. | |
| D328,657 | S | 8/1992 | Steele | |
| 5,357,735 | A | 10/1994 | Fry | |
| 5,822,950 | A | 10/1998 | deMoya et al. | |
| 6,105,346 | A | 8/2000 | Hsi-Chang | |
| 6,202,393 | B1 | 3/2001 | Myler et al. | |
| 6,305,152 | B1 | 10/2001 | Myler et al. | |
| 6,449,930 | B2 | 9/2002 | Robart et al. | |
| 6,490,848 | B2 | 12/2002 | Myler et al. | |
| 2002/0007619 | A1 | 1/2002 | Myler et al. | |
| 2002/0139094 | A1 | 10/2002 | Jonsson | |

FOREIGN PATENT DOCUMENTS

| | | |
|---|---|---|
| DE | 10018417 | 10/2001 |
| EP | 0842893 | 5/1998 |
| EP | 1195351 | 4/2002 |
| GB | 2229905 | 10/1990 |

OTHER PUBLICATIONS

Henderson, Carolyn, *The New Book of Saddlery and Tack*, Howell Book House, NY, ©1981, 1998, QUARTO, Inc., p. 128.

* cited by examiner

*Primary Examiner*—Son T Nguyen
(74) *Attorney, Agent, or Firm*—Richard C. Litman

(57) ABSTRACT

The present invention comprises a series of embodiments of a swivel cheeked bridle bit wherein the cheek portion, comprising a dee and/or lower or curb rein attachment eye or ring, is separate from the purchase, with the purchase serving as a pintle for the swivel attachment of the cheek portion to the remainder of the bit structure. The upper harness attachment ring, for attaching a curb chain, nose strap, and/or cheek strap to the bit, is immovably affixed to the upper end of the purchase, which in turn is immovably affixed to the mouth bar of the bit. This ensures that the upper ring does not rotate or swivel as the cheek is turned, thus avoiding twisting the ends of the straps attached to the upper ring and precluding turning the edge of the attachment ring and any attached straps into the side of the face of the animal.

20 Claims, 5 Drawing Sheets

SWIVEL CHEEKED BRIDLE BIT

BACKGROUND OF THE INVENTION

1. Field of the Invention

The present invention relates generally to harness animal tack and accessories, and more particularly to a bridle bit for horses and the like. The present bridle bit has swivel cheek components, but rather than integrating the swiveling cheek components with their corresponding nose band and/or headstall purchase ring or eye, thus causing the purchase ring to swivel in unison with the swivel cheek component, the present invention immovably affixes the upper or purchase ring with the mouth bar of the bit, with only the lower, rein attachment ring or eye and "dee" eye or ring swiveling in unison according to rein pull.

2. Description of the Related Art

The utility of larger animals for various purposes, i.e., as a power source, for pulling a heavy load, riding, etc., has been recognized for ages. However, it is also apparent that some form of control must be provided in order to cause the animal to perform as desired. Accordingly, halters, reins, leashes, and/or other restraining devices began to be developed when animals began to be domesticated and employed for various purposes.

Numerous variations and improvements upon the basic harness, halter, and rein concept have been developed over the years, with the term "tack" being applied to the wide range of equipment used in the handling and control of large domesticated animals, particularly horses. Early in the development of such equipment, it was found that the placement of some device in the mouth of the animal, and working or manipulating that device, was extremely effective in controlling the animal as desired. The tissues of the mouth are relatively sensitive, allowing the animal to sense the desired action with minimal pressure, after proper training. As a result, the bit and closely related attachments have proven to be particularly important components in the fields of tack, harness, and saddlery.

Accordingly, the bridle and bit have received a considerable amount of attention, with practically innumerable variations of the assembly having been developed over the years. It is critical that such devices provide for the attachment of suitable control reins, attachment straps, etc., and such bridle assemblies conventionally include a series of "purchases," rings, or eyes for the attachment of various straps, reins, etc. In its simplest form, the bit and its harness attachment components are formed as a unitary device, with no relatively moving components. However, such a bit has not been found to be optimally effective, as it provides no variation for altering the attach points of reins and other components, adjustability, or versatility for various uses (e.g., training, working cattle, competition riding, etc.).

One somewhat common variation upon the bridle bit is the "swivel cheeked" bit, wherein the cheek piece, which extends from each end of the mouth bar of the bit, is pivotally attached to the mouth bar. With a swivel cheeked bit, the cheeks normally swivel outwardly and downwardly when the reins are slack. A light tension on a given rein tends to pull the corresponding cheek upwardly and inwardly, to touch the side of the horse's face (or cheek) adjacent the corner of the mouth. A gentle, slight tug on one rein is sufficient to move the cheek piece, without need to tug more firmly upon the rein and move the mouth bar against the sensitive tissues within the mouth of the animal.

However, such swivel cheeked bits are commonly constructed with the upper or purchase ring integrally formed with the cheek piece and dee components. As a result, the swiveling of one of these components relative to the mouth bar of the bit results in corresponding swiveling of the remaining components. As the upper or bridle attachment ring or eye of the assembly must swivel with any swiveling action of the cheek piece, dee, and/or rein attachment ring or eye, it will be seen that any harness or bridle straps attached to the upper ring will be twisted during the swiveling of their attachment ring. This can result in such straps, particularly the nose band, twisting laterally as its attachment ring swivels or rotates due to the swiveling of other components when a rein is pulled. When this occurs, the rearward edge of the strap tends to bear into the somewhat sensitive flesh along the side of the nose of the animal, and can abrade this area over a period of time.

The present swivel cheeked bridle bit responds to this problem, by forming the upper purchase rings or eyes as a fixed, monolithic structure integrated immovably with the mouth bar of the bit. Yet, the cheek rings and dees which provide for the attachment of reins thereto, swivel on the purchase attachment bar, to allow a slight tug on either rein to swivel the cheek piece and dee to guide the animal as desired. The nose strap and other bridle attachments remain stationary to allow the straps to rest flat against the animal's face, thereby avoiding discomfort and/or injury to the animal and subsequent potential difficulties in working with the animal.

A discussion of the related art of which the present inventor is aware, and its differences and distinctions from the present invention, is provided below.

U.S. Pat. No. 529,472 issued on Nov. 20, 1894 to Melvin F. Bigelow, titled "Bridle Bit," describes a bit assembly in which the cheek pieces are immovably affixed to the mouth piece or mouth bar. The only movable components of the Bigelow bit are the relatively large diameter rein attachment rings, which extend from their attachments at the intersection of the mouth bar with the cheek pieces. The only relative movement between components is the swivel attachment of the larger rein attachment rings to the fixed, non-swiveling cheek pieces; the lower curb rein attachment rings are immovably affixed to the fixed cheek pieces.

U.S. Pat. No. 962,134 issued on Jun. 21, 1910 to Washington J. Engle, titled "Bit," describes a bit assembly with movable components engaging the sides of the horse's face when the corresponding rein is pulled. However, the large, octagonal cheek pieces are immovably affixed to the mouth bar of the bit; they do not swivel, as is the case with the present bit.

U.S. Pat. No. 3,205,636 issued on Sep. 14, 1965 to William D. Laningham, titled "Horse Mouth Bit," describes a bit in which the mouth bar is rotationally mounted between the two opposed side members of the assembly. The side members (which might be considered the cheek pieces of the bit) are rigidly and immovably interconnected by a second crossmember below the mouth bar. Laningham provides a "protective buffer element," comprising a rotary disc, at each end of the mouth bar. However, these discs do not swivel outwardly from the planes of their discs, as in the motion of a conventional swivel mounted dee and cheek piece. It is also noted that the upper rings of the Laningham bit may swivel within the upper ends of the side members, thus teaching away from the immovably affixed upper rings of the present swivel cheeked bit.

U.S. Pat. No. 3,208,196 issued on Sep. 28, 1965 to David Ferguson, titled "Flexible Horse Bit," describes a bit having swivel mounted dees at each end of the mouth bar. The mouth bar has a side member immovably affixed to each end thereof, with the dees being pivotally mounted on the corresponding side members. Ferguson does not provide any other upper or curb rein attachment rings to his bit, whereas the present bit includes such additional attachment rings or eyes. Rather, all reins, cheek straps, nose straps, curb straps, etc. of the Ferguson bit, must be attached either directly or indirectly to the single swiveling dee on each side of the bit.

U.S. Pat. No. 4,587,797 issued on May 13, 1986 to Ulrich Conrad, titled "Bridoon Bit," describes numerous bridle bit embodiments, most of which are provided with only a single swivel mounted rein and halter attachment ring at each end of the mouth bar. The same points noted in the discussion of the bit of the Ferguson '196 U.S. Patent immediately above, are applicable here as well. Some embodiments include cheek pieces which extend from each end of the mouth bar. However, these cheek piece bits do not provide for rotation or swiveling of the cheek pieces within their passages in the ends of the mouth bar, but are immovably affixed to the mouth bar, per column 7, lines 57 and 58 of the Conrad disclosure.

U.S. Pat. No. 4,884,390 issued on Dec. 5, 1989 to Leo Benjak et al., titled "Bridle Bit," describes a bit assembly in which various components rotate relative to one another. Each end of the mouth bar includes a shank pivotally secured therein, from which the headstall attachment rings extend. The curb rein attachment rings are pivotally secured to the opposite ends of the shanks. While the rein attachment rings rotate independently of the opposite head stall attachment rings, these head stall rings of the Benjak et al. bit are nevertheless free to rotate in accordance with the shifting of the bit and attachment straps. The problem of the various head stall, nose, curb, and/or other attachment straps twisting against the side of the horse's face due to rotation of the head stall ring, is still a problem with the Benjak et al. bit. The present bit precludes this potential problem by means of its fixed upper ring and purchase.

U.S. Pat. No. 4,941,312 issued on Jul. 27, 1990 to Ralph N. Old, Sr., titled "Bridle Bit," describes a relatively complex bit assembly having a rearwardly turned curb chain ring and a nose and cheek strap attachment ring extending upwardly from a dee on each side of the assembly. The mouth bar of the bit also extends between the two dees, rather than being affixed to the two purchases or shanks defining the sides of the bit. The lower curb rein attachment rings extend from the lower ends of the shanks and are adjustably affixed thereto, but do not rotate relative to the shanks, unlike the present bit. Thus, the lower or curb rein attachment rings and upper strap and curb chain attachment rings are immovably affixed to one another, with rotation of one causing rotation of the other, unlike the present bit where the lower rein attachment ring is free to rotate independently of the fixed upper ring.

U.S. Pat. No. 5,062,255 issued on Nov. 5, 1991 to Ronald J. Myler et al., titled "Bridle Bit," is a continuation in part of the Benjak et al. '390 U.S. Patent discussed further above, with both Benjak and Myler being co-inventors in both of the issued patents. The primary difference between the two is that a stop is provided at the attachment of the rein attachment ring arm to their attachment shanks or cheek pieces, to limit the rotation of the rein attachment ring arms. Accordingly, the same points of distinction noted further above in the discussion of the Benjak et al. '390 U.S. Patent are seen to apply here as well.

U.S. Pat. No. 5,357,735 issued on Oct. 25, 1994 to Donald G. Fry, titled "Adjustable Horse Bit," describes a bit having a multiple piece, snaffle type mouth piece. Each end of the mouth bar includes an eye, with a single rein attachment ring installed loosely through each eye. The inventive feature of the Fry bit is the threaded adjuster in each side of the snaffle mouth bar, to adjust the width of the assembly. No fixed upper harness ring and swiveling dee and lower rein attachment ring, are disclosed by Fry.

U.S. Pat. No. 5,822,950 issued on Oct. 20, 1998 to Jorge de Moya et al., titled "Maestro Mouthpiece," describes a bit assembly in which the central portion of the mouthpiece can rotate between the two end members. A shank extends generally downwardly from each of the end members, with a dee portion swivelly mounted on the shank and straddling each end member. While the dees can pivot or swivel on the shanks, the two shanks are immovably affixed to the end members and cannot swivel relative thereto. While the lower ends of the fixed shanks include rein attachment rings installed therein, the rings are loosely mounted, and their movement is completely independent of any swiveling action of the dees. This construction is substantially opposite that of the present bridle bit, with its fixed upper rings and swiveling lower rings and dees.

U.S. Pat. No. 6,105,346 issued on Aug. 22, 2000 to Chang Hsi-Chang, titled "Rotatable, Adjustable-Width Bar Bit," describes a bit having a mouth bar with the ends rotatably attached to the opposite cheek assemblies, much like the bit of the Laningham '636 U.S. Patent discussed further above. The dee, upper ring, and lower ring component on each side of the mouth bar comprises a unitary, monolithic structure. While these dee and ring components can swivel relative to the ends of the mouth bar, the swivel action of the upper rings in unison with the dees and lower rings, teaches away from the present invention with its relatively fixed upper rings and swiveling dees and lower rings.

U.S. Pat. No. 6,202,393 issued on Mar. 20, 2001 to Ronald J. Myler et al., titled "Bridle Bit," describes a multiple piece, snaffle type bit assembly having pivotally attached dees at each end thereof for strap and rein attachment. Each of the dees includes an upper and a lower slot therein, for rein and strap attachment. Accordingly, the upper strap attachment point of the Myler et al. bit is not fixed relative to the mouth bar, as it is in the present bridle bit.

U.S. Pat. No. 6,305,152 issued on Oct. 23, 2001 to Ronald J. Myler et al., titled "Horse Control Device," describes multiple embodiments of a bridle bit assembly, with each of the embodiments having single piece, unitary cheek pieces with the headstall and rein attachment rings formed integrally therewith. No separate movement of the dee and rein attachment ring from the upper headstall attachment ring is possible, with any of the Myler et al. bridle bit embodiments.

U.S. Pat. No. 6,449,930 issued on Sep. 17, 2002 to David Robart et al., titled "Pinchless Bridle Bit," describes numerous embodiments of a bridle bit, with various headstall, rein, and other attachments shown. Some of the embodiments include swivel mounted cheek pieces, with the embodiment of FIG. 23 disclosing interchangeable, swivel mounted dee and lower ring attachment shank members. However, the two components cannot be used together to form a unitary dee and lower rein attachment ring or cheek piece, as is accomplished in the present invention.

U.S. Pat. No. 6,490,848 issued on Dec. 10, 2002 to Ronald James Myler et al., titled "Horse Control Device," is a continuation in part of the Myler et al. '152 U.S. Patent discussed further above. The same points of difference between the device of the Myler et al. '152 U.S. Patent and the present invention noted in that discussion, are seen to apply here as well.

U.S. Patent Publication No. 2002/0,007,619 to Ronald J. Myler et al., published on Jan. 24, 2002, titled "Horse Control Device," is also a continuation in part of the Myler et al. '152 U.S. Patent discussed further above. The same points of difference between the device of the Myler et al. '152 U.S. Patent and the present invention noted in that discussion, are seen to apply here as well.

U.S. Patent Publication No. 2002/0,139,094 published on Oct. 3, 2002 to Magnus O. Jonsson, titled "Bridle Bit," describes a multiple piece, snaffle type bit having the opposed cheek pieces secured to the ends of the mouth bar by ball joint fittings. Each cheek piece includes upper and lower rein and strap attachment rings, monolithically formed therewith as a single, unitary component. Thus, if the cheek pieces and/or lower attachment rings swivel or pivot outwardly, so do their upper strap attachment rings as well, in contrast to the present invention with its fixed upper harness attachment rings and swiveling dees and lower rings.

U.S. Pat. No. D-328,657 issued on Aug. 11, 1992 to Thomas L. Steele, titled "Horse Bit," illustrates a design comprising a multiple piece, snaffle type mouth bar with its ends having passages through which curved members of the cheek pieces pass. The cheek piece and upper and lower rings of each side are formed monolithically as a unitary structure with no relatively moving components, in contrast to the present swivel cheeked bit with its fixed upper ring and swiveling dee and lower ring.

British Patent Publication No. 2,229,905 published on Oct. 10, 1990 to Frederica C. Newman, titled "Equestrian Training Aid," describes a multiple piece, snaffle type mouth bar with a large rein and strap attachment ring at each end thereof. A weighted curb chain is removably attached to the rings, with the object being to weight the chain to affect the carriage of the head of the horse wearing the device. No dee having an integral lower rein attachment ring or upper ring integrated with the mouth bar is disclosed in the Newman '905 British Patent Publication, which features are components of the present swivel cheeked bridle bit invention.

European Patent Publication No. 842,893 published on May 20, 1998 to Ulrich Conrad, titled "Horse-Bit," describes (according to the drawings and English abstract) a series of embodiments of a multiple piece, snaffle type mouth bar having swiveling cheek pieces. However, the upper harness attachment ring and dee of each cheek piece are formed as unitary, monolithic components and cannot move relative to one another. No lower, curb rein attachment ring is disclosed in the '893 European Patent Publication.

German Patent Publication No. 10,018,417 published on Oct. 25, 2001 to Herm Sprenger GMBH, titled "Horse Bit; . . . ," describes (according to the drawings and English abstract) a bit having a mouth bar with side components immovably affixed thereto. Rein attachment rings are loosely installed to the lower ends of the side components, with a loose strap or tie apparently provided at the opposite ends of the side components. No swiveling dee with an integral lower rein attachment ring, nor upper harness attachment ring immovably affixed to the mouth bar, is disclosed in the '417 German Patent Publication.

European Patent Publication No. 1,195,351 published on Apr. 10, 2002 to Herm Springer GMBH, titled "Horse Bit And Its Production Method," describes a multiple piece, snaffle type mouth bar having cheek pieces formed of a flexible material. The central portion or dee of each cheek piece has an opening therein, permitting the dee to be opened and spread for the insertion of a pin into a passage on each end of the mouth bar. No swiveling components are apparent in the '351 Publication.

Finally, *The New Book of Saddlery and Tack* (Carolyn Henderson, consulting editor), published by Howell Book House (New York), 1998, discloses on p. 128 a series of bridle bits having swivelly attached dees, harness attachment rings, and rein attachment rings. In each case, the dees and upper harness or curb chain rings are formed as integral, unitary components and are immovably affixed to one another, unlike the present bridle bit invention. The lower rein attachment rings, where provided, are swivelly attached to extensions depending from the dees, rather than being formed integrally with the swiveling dee.

None of the above inventions and patents, taken either singly or in combination, is seen to describe the instant invention as claimed.

SUMMARY OF THE INVENTION

The present invention comprises a swivel cheeked bridle bit primarily intended for use with horses, along with other conventional tack and/or saddlery. The present bit essentially comprises a mouthpiece or bar, with a "purchase" or shank and upper harness attachment ring immovably affixed to each end of the mouth bar and formed integrally therewith. A dee and lower rein attachment ring are immovably affixed to and formed integrally with one another. The purchase or shank serves as a pintle or pivot shaft for the dee and lower ring, with the dee and lower ring swiveling on the purchase shank while the upper ring remains stationary relative to the mouth bar.

The above described swivel cheeked bit configuration provides significant advantages over other swivel cheeked bits of the prior art. The present bit immovably affixes the upper ring for attachment of the nose strap, cheek strap, and/or curb chain to the bit by means of the purchase shank integrally and monolithically formed therewith, thus assuring that the upper ring cannot rotate as the lower rein attachment ring and dee swivel about the purchase pintle. This allows the nose band to remain flat across the nose of the animal regardless of the orientation of the rein attachment rings and/or dees, rather than being twisted from its attachment to a rotating ring. This greatly increases comfort for the animal, and precludes chafing or cutting the nose of the animal by the edge of the band.

Yet, the dees and lower or curb rein attachment rings are free to swivel about their attachment to the purchase shank or pintle, to provide the advantages of conventional swivel cheeked bits. The point behind such bits is to allow the dees and lower rein attachment rings to swivel or pivot downwardly and outwardly when there is little or no tension on the reins. This results in "softening" a tug or pull on either rein, by first pivoting or swiveling the dee and/or lower rein attachment ring upwardly and rearwardly against the side of the horse's face as the rein is pulled. A well trained animal will quickly recognize this command without need for the rider to apply harsh pressures to the mouth bar of the bit, particularly when such light pressure is integrated with the touch of the rein along the side of the animal's neck.

The present swivel cheeked bit may be implemented in a large number of different bit variations, such as unitary mouth bar bits, either with or without other components extending from the mouth bar; multiple piece mouth bar, snaffle type bits; and bits having dees of any practicable configuration, either with or without a lower rein attachment ring of any practicable configuration.

Accordingly, it is a principal object of the invention to provide a swivel cheeked bridle bit for harness animals, particularly for horses, in which the upper harness attachment eye or ring is immovably affixed to the mouth bar of the bit to preclude movement or rotation of the ring, while the dee and/or lower rein attachment ring is pivotally attached to the mouth bar.

It is another object of the invention to provide a bridle bit wherein the purchase extending from each side of the mouth bar is a separate component from the cheek component of the bit, with the cheek component, comprising the dee and/or lower rein attachment ring, pivotally attached to the purchase.

Still another object of the invention is to provide various embodiments of a swivel cheeked bridle bit, including bits having single piece mouth bars, snaffle type bits having multiple piece mouth bars, and bits having swivelly attached dees and/or lower rein attachment rings, as desired.

It is a further object of the invention to improve the comfort of a harness animal by precluding twisting movement of the upper attachment ring or eye and any straps or harness components attached thereto, when the corresponding dee and/or lower rein attachment ring swivels relative to the remainder of the bit structure.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises several embodiments of a swivel cheeked bridle bit for harness animals, and more particularly for horses. The present swivel cheeked bit includes swivel or pivotally attached cheek, dee, and lower rein attachment ring portions, but unlike other swivel cheeked bits of the related art, the upper ring used for nose band, cheek strap, and/or curb chain attachment is immovably affixed to the purchase shank of the bit, which is, in turn, immovably affixed to the mouth bar of the bit.

This assures that the upper ring will remain parallel to the face or cheek of the animal, and will not twist with pivotal movement of the bit cheek(s). This provides greater comfort to the animal, as the various straps and bands attaching to the relatively stationary upper ring remain flat against the sides of the animal's face, and do not twist to have their edges cut into the animal's face as is the case with conventional swivel cheeked bits where the upper ring swivels or pivots in unison with the cheek portions of the bit. The animal thus remains more comfortable and is not distracted by the edges of the straps or bands, as is the case with other swivel cheeked bits.

Figure 1:
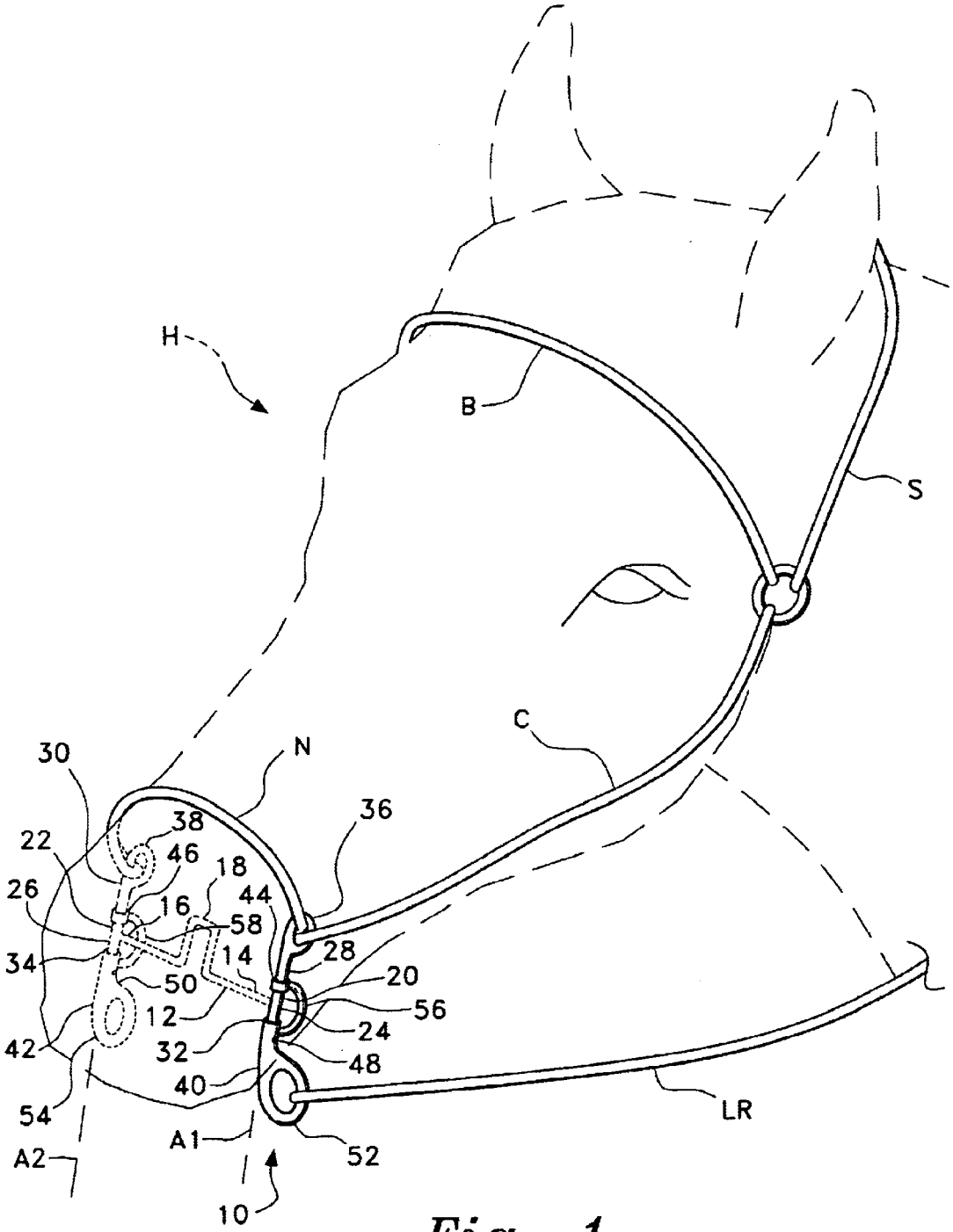
FIG. 1 is an environmental, perspective view of a swivel cheeked bridle bit according to the present invention, showing its general configuration and features.
Figure 2:
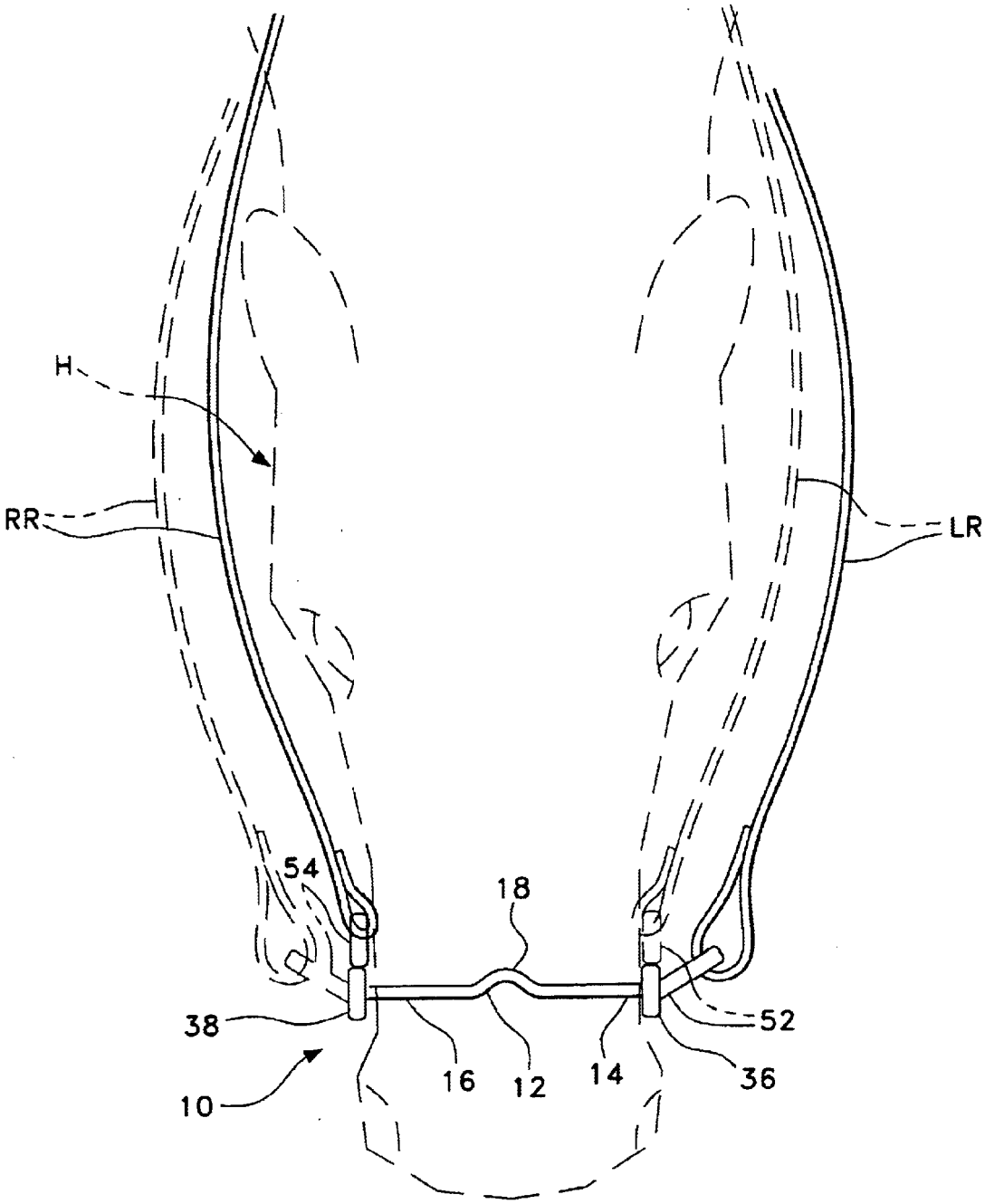
FIG. 2 is a top plan view of the swivel cheeked bit of FIG. 1, showing the operation and function of the swiveling cheek components of the bit.

FIGS. 1 and 2 illustrate a first embodiment of the present swivel cheeked bridle bit, designated by the reference numeral 10. The swivel cheeked bit 10 is shown as it would be placed on a horse H, in position across the mouth of the horse H. While the present swivel cheeked bit 10 is novel, the remainder of the tack or harness is conventional, comprising a nose band N, a cheek strap C, a brow band B, a head stall strap S, and left and right reins LR and RR. The conventional chin strap or curb chain and throat latch are not shown in FIG. 1, for clarity in the drawing. It will be understood that this arrangement is laterally symmetrical with left and right side components where applicable, but only the left side components are visible in FIG. 1.

The swivel cheeked bit 10 of FIGS. 1 and 2 includes a mouth bar 12 having a first or left end 14, and an opposite second or right end 16. "Left" and "right" in FIGS. 1 and 2 are relative to the left and right side of the horse H illustrated, with left and right components respectively being on the right and left sides of the drawing in the perspective and top plan views respectively of FIGS. 1 and 2. The mouth bar 12 of the bit 10 shown in FIGS. 1 and 2 is a single, unitary component formed of a single bar or rod of metal or other suitable material. The mouth bar 12 includes a tongue relief port 18 formed generally centrally therein, but may take on any of a number of different configurations as desired, a few of which are illustrated in subsequent drawings, and discussed further below.

A first or left side and second or right side purchase shank, respectively 20 and 22, extend respectively from each end 14 and 16 of the mouth bar 12. The two purchase shanks 20 and 22 have generally medial portions, respectively 24 and 26, which are immovably affixed to the respective mouth bar ends 14 and 16. Each of the purchases 20 and 22 includes a first or upper end, respectively 28 and 30, and an opposite second or lower end, respectively 32 and 34, extending from their respective medial portions 24 and 26. The purchase shanks 20 and 22 are generally normal to the mouth bar 12, with the mouth bar 12 and purchases 20 and 22 forming a generally H-shaped configuration.

Each purchase shank 20 and 22 includes an upper ring or eye, respectively 36 and 38, extending therefrom. These upper rings or eyes 36 and 38 provide for the attachment of various harness and tack components to the bit 10, i.e., the nose band N, cheek strap C, and curb chain or chin strap, not shown. The two rings 36 and 38 are oriented with their planes generally parallel to the sides of the face of the horse H, i.e., with their axes generally parallel to the elongate mouth bar 12 of the bit 10. The rings 36 and 38 are immovably affixed to the respective upper ends 28 and 30 of the first and second purchases 20 and 22, e.g., welded, forged as a unitary structure, etc. Thus, the two upper rings or eyes 36 and 38 cannot rotate relative to the mouth bar 12 or purchase shanks 20 and 22, but retain the same orientation relative to those components 12, 20, and 22 at all times.

Left 40, or first, and right 42, or second, cheek pieces, respectively, pivotally attach respectively to the left and right purchases 20 and 22. Each cheek piece 40 and 42 has an upper purchase shank attachment passage, respectively 44 and 46, and an opposite lower purchase shank attachment passage, respectively 48 and 50, extending therefrom. Each of the upper attachment passages 44 and 46 comprises an eye or loop formed around the upper end portion 28 and 30 of the respective purchase shank 20 and 22, in the manner of a hinge loop or eye about the pintle of a hinge, to allow the cheek pieces 40 and 42 to swivel upon their respective purchase shanks 20 and 22.

The lower purchase shank attachment passages 48 and 50 may also comprise loops, eyes, or similar structures, but may instead comprise closed sockets secured concentrically about the respective lower purchase shank ends 32 and 34, as shown in the drawings. The upper purchase shank attachment passages 44 and 46 and the lower purchase shank attachment passages 48 and 50, are positioned to each side of the mouth bar 12 attachment with the medial portions 24 and 26 of their respective purchase shanks 20 and 22, to preclude removal of the cheek pieces 40 and 42 from the remainder of the bit structure. The lower shank attachment passages 48 and 50 each have a closed lower rein attachment ring or eye, respectively 52 and 54, extending therefrom and immovably affixed thereto. As the purchase attachment passages or sockets 48 and 50 of the two cheek pieces 40 and 42 swivel or pivot about their respective purchase lower ends 32 and 34, so do their respective lower rings or eyes 52 and 54.

Each upper and lower purchase attachment passage of the two cheek pieces, i.e., upper and lower attachment passages 44 and 48 of the first cheek 40 and upper and lower attachment passages 46 and 50 of the second cheek 42, are preferably connected by closed dee rings or eyes, such as first or left side dee 56 and second or right side dee 58, respectively. The dees 56 and 58 not only serve to connect their respective upper and lower cheek attach fittings or passages together to unify each cheek piece, but also serve as another attachment for the reins, if higher placement of the reins is desired. While the term "dee" is used conventionally to describe a closed semicircular rein attachment eye or passage generally surrounding the attachment of the mouth bar with each purchase shank of the bit, it will be understood that such dees may have any practicable shape or configuration, as desired.

Figure 3:
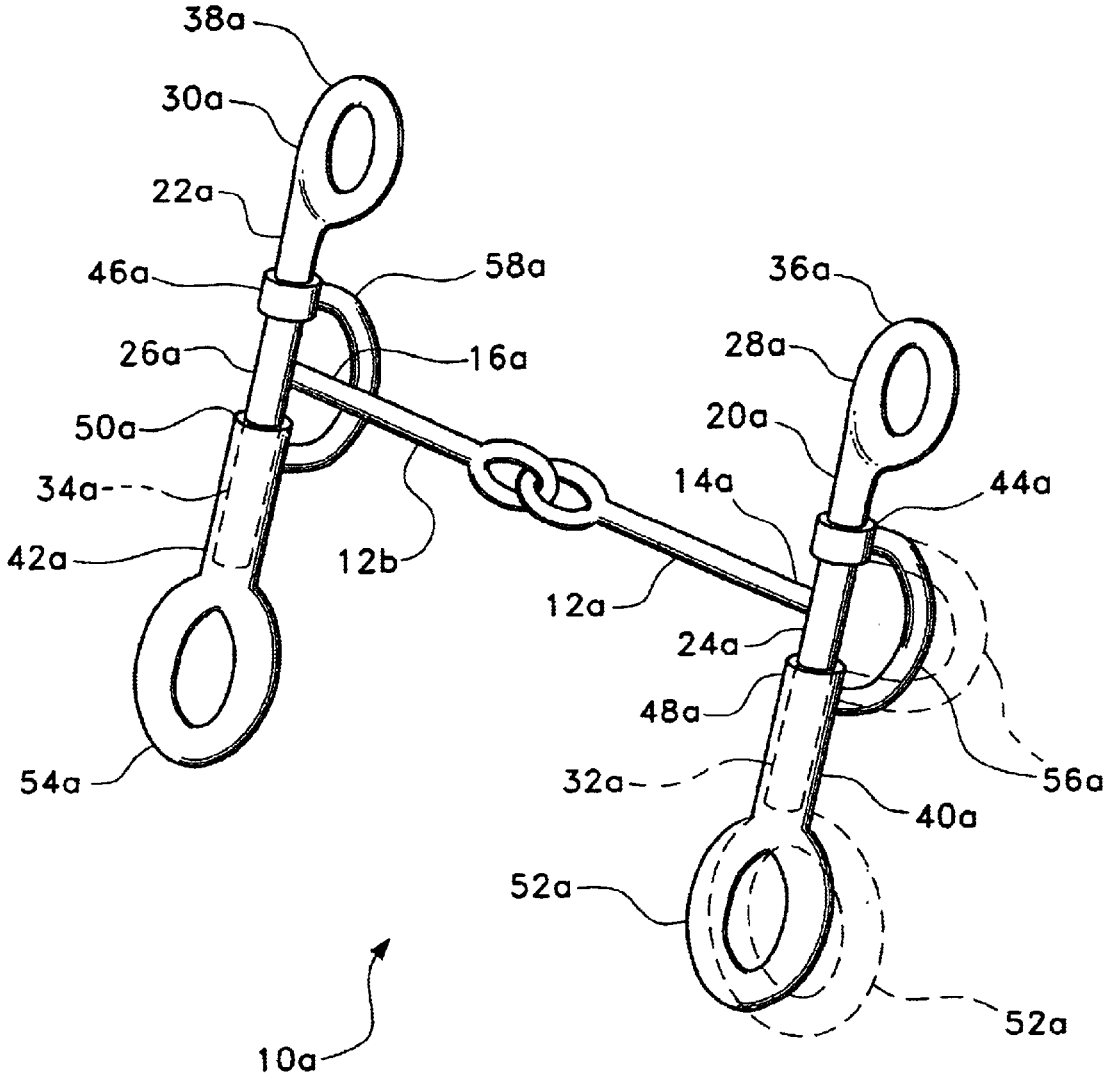
FIG. 3 is a perspective view from the front left side of an alternative embodiment of a bridle bit with a snaffle type bit having a multiple piece mouth bar, and incorporating the swivel cheeks of the present invention.

The swiveling lower rein attachment eyes 52 and 54, used for curb rein attachment or the like, may extend straight downwardly from their respective cheeks 40 and 42, as shown in FIG. 3. However, they may also be displaced from the axes A1 and A2 of the two purchase shanks 20 and 22 if so desired, as shown in FIGS. 1 and 2. FIG. 2 illustrates the operation of the swivel cheeked bit 10 of FIG. 1, with its axially displaced lower attachment rings 52 and 54. Depending upon how the horse H carries its head, this may allow the two rings or eyes 52 and 54, along with their dees 56 and 58, to swivel forwardly and outwardly away from the horse's face when the reins are somewhat slack, somewhat as shown by the left rein LR and left lower ring 52 in solid lines in the top plan view of FIG. 2.

In this manner, a rider need only draw some slight tension on the desired rein to swivel the corresponding cheek piece lightly against the cheek of the horse H, as shown in the broken line showing of the left rein LR and left lower ring 52, and solid line showing of the right rein RR and right lower ring 54 in FIG. 2. Thus, no undue pressure or force need be exerted upon the mouth bar 12 of the bit 10. A well trained horse will readily recognize this technique, and will respond without need for further drawing of the rein and corresponding force on the mouth bar of the bit. Yet, upper attachment rings or eyes of the present swivel cheeked bit remain stationary to preclude twisting of the corresponding straps, i.e., the nose band N and cheek strap C, into the side of the face of the horse H. This provides less irritation and greater comfort for the animal, which results in a more tractable and docile animal which is more easily controlled and worked.

FIG. 3 illustrates an alternative embodiment of the present swivel cheeked bridle bit, comprising a snaffle type bit 10*a* with a multiple piece mouth bar having a first or left side 12*a* and opposite second or right side 12*b*. The two portions 12*a* and 12*b* of the mouth bar are flexibly linked together, e.g., by a pair of interlinked eyes, as is conventional in the art of snaffle type bits.

The basic structure of the swivel cheek bit 10*a* of FIG. 3 is otherwise similar to the structure of the bit 10 illustrated in FIGS. 1 and 2, and discussed in detail further above. Each of the mouth bar portions 12*a* and 12*b* has an outboard end, respectively 14*a* and 16*a*, which is immovably affixed to the respective first 20*a*, or left, and second 22*a*, or right, purchase shank at their respective medial portions 24*a* and 26*a*. The two purchase shanks 20*a* and 22*a* each have an upper end, respectively 28*a* and 30*a*, and an opposite lower end, respectively 32*a* and 34*a*. The upper ends 28*a* and 30*a* each terminate in an upper harness attachment ring or eye, respectively 36*a* and 38*a*, which is immovably affixed (e.g., forged, welded, etc.) to the upper ends 28*a* and 30*a* of the two purchase shanks 20*a* and 22*a*.

The lower ends 32*a* and 34*a* of the two purchases 20*a* and 22*a* each have a swiveling cheek piece thereon, respectively first or left and second or right swivel cheeks 40*a* and 42*a*. These swiveling cheek pieces 40*a* and 42*a* include respective upper purchase attachments 44*a* and 46*a*, and lower purchase attachments 48*a* and 50*a*. The upper purchase attachments 44*a* and 46*a* may comprise rings or eyes which encircle the upper portions 28*a* and 30*a* of their respective purchase shanks 20*a* and 22*a*, with the opposite lower purchase attachments 48*a* and 50*a* possibly being similarly configured, but more preferably being configured as closed sockets in the manner of the swivel cheeked bit 10 of FIGS. 1 and 2. The two lower purchase shank attachments 48*a* and 50*a* each include a lower or curb rein attachment ring or eye extending therefrom, respectively lower rings 52*a* and 54*a*. These lower rein attachment rings 52*a* and 54*a* may be angled relative to the swivel axes defined by their respective purchase shanks 20*a* and 22*a*, as in the case of the bit 10 of FIGS. 1 and 2, or may be aligned with their respective pivot axes, as shown in FIG. 3.

As in the case of the swivel cheek bit 10 of FIGS. 1 and 2, the bit 10*a* of FIG. 3 also includes dees, respectively 56*a* and 58*a*, which connect the respective upper attachment passages 44*a* and 46*a* and their lower attachment passages or sockets 48*a* and 50*a*. These serve to interconnect the upper and lower attachment passages or fittings securing each of the swivel cheeks 40*a* and 42*a* to their respective purchase shanks 20*a* and 22*a*, as well as providing another rein attachment point for each side of the bit 10*a*. FIG. 3 clearly shows the swiveling action of the left side cheek piece 40*a*, with the outwardly swiveled orientation of the lower ring or eye 52*a* and its corresponding dee 56*a*, shown in broken lines in FIG. 3.

In the cases of the bits 10 and 10*a* of FIGS. 1 through 3, a review of those drawings, will show that the swiveling lower rein attachment rings, i.e. 52 and 54 or 52*a* and 54*a*, have a somewhat larger diameter than the corresponding fixed rings or eyes 36 and 38 or 36*a* and 38*a*.

Conventionally, the lower rings or eyes of a bridle bit are configured somewhat larger than the upper rings, and this is the case for the bit 10 of FIGS. 1 and 2 and the bit 10*a* of FIG. 3. However, it will be understood that either the upper rings or the lower rings may be made larger or smaller as desired and still retain the inventive feature of the present swivel cheeked bit, i.e., having fixed upper bridle or harness attachment rings and cheeks, dees, and lower rein attachment rings which swivel independently of the fixed upper rings.

Figure 4:
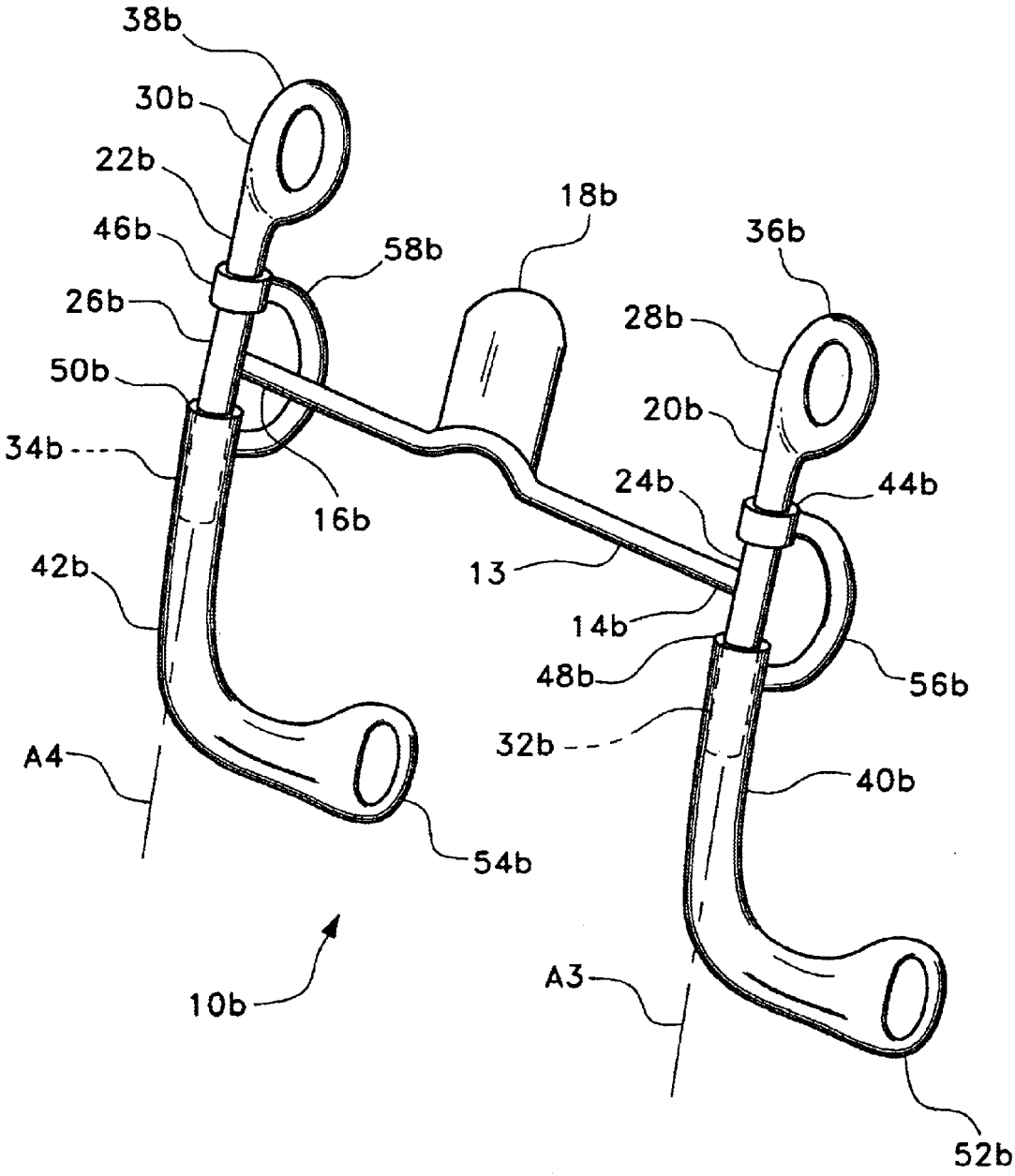
FIG. 4 is a front left side perspective view of another alternative embodiment of a bridle bit having a hooded type mouth bar, and incorporating the swivel cheeks of the present invention.

FIG. 4 provides a perspective view of yet another embodiment of the present swivel cheeked bit, designated as bit 10*b*. The bit 10*b* differs from the single piece mouth bar bit 10 of FIGS. 1 and 2, in that the mouth bar 12*b* of the bit 10*b* includes a hood 18*b* extending from the general center of the mouth bar 12*b*, in lieu of the tongue port 18 of the bit 10 shown in FIGS. 1 and 2. The lower portions of the swivel cheeks and their rein attachment rings also differ somewhat from the bit 10 of FIGS. 1 and 2.

Otherwise, the basic structure of the swivel cheek bit 10*b* of FIG. 4 is similar to the structure of the bit 10 illustrated in FIGS. 1 and 2, and discussed in detail further above. The mouth bar 13 has opposite first or left and second or right ends, respectively 14*b* and 16*b*, which are immovably affixed to the respective first or left and second or right purchase shank 20*b* and 22*b* at their respective medial portions 24*b* and 26*b*. The two purchase shanks 20*b* and 22*b* each have an upper end, respectively 28*b* and 30*b*, and an opposite lower end, respectively 32*b* and 34*b*. The upper ends 28*b* and 30*b* each terminate in an upper harness attachment ring or eye, respectively 36*b* and 38*b*, which are immovably affixed (e.g., forged, welded, etc.) to the upper ends 28*b* and 30*b* of the two purchase shanks 20*b* and 22*b*.

The lower ends 32*b* and 34*b* of the two purchases 20*b* and 22*b* each have a swiveling cheek piece thereon, respectively first or left and second or right swivel cheeks 40*b* and 42*b*. These swiveling cheek pieces 40*b* and 42*b* include respective upper purchase attachments 44*b* and 46*b*, and lower purchase attachments 48*b* and 50*b*. The upper purchase attachments 44*b* and 46*b* may comprise rings or eyes which encircle the upper portions 28*b* and 30*b* of their respective purchase shanks 20*b* and 22*b*, with the opposite lower purchase attachments 48*b* and 50*b* possibly being similarly configured, but more preferably being configured as closed sockets in the manner of the swivel cheeked bit 10 of FIGS. 1 and 2. The two swiveling cheek components 40*b* and 42*b* each include an axially offset lower end which terminates in a rein attachment ring or eye, respectively 52*b* and 54*b*. It will be noted that the lower ends of the cheek components 40*b* and 42*b*, and their respective rein attachment rings 52*b* and 54*b*, are offset from their respective axes A3 and A4, to an even greater degree than the axial offset of the corresponding components of the swivel cheek bit 10 of FIGS. 1 and 2. Again, such lower rein attachment ring offset may or may not be provided with any of the embodiments of the present swivel cheeked bit, as desired.

As in the case of the swivel cheek bit 10 of FIGS. 1 and 2, the bit 10*b* of FIG. 4 also includes dees, respectively 56*b* and 58*b*, which connect the respective upper attachment passages 44*b* and 46*b* and their lower attachment passages or sockets 48*b* and 50*b*. These serve to interconnect the upper and lower attachment passages or fittings securing each of the swivel cheeks 40*b* and 42*b* to their respective purchase shanks 20*b* and 22*b*, as well as providing another rein attachment point for each side of the bit 10*b*. The two cheek pieces 40*b* and 42*b*, with their respective lower rings 52*b* and 54*b* and dees 56*b* and 58*b*, swivel about the fixed purchase shanks 20*b* and 22*b*, in the manner illustrated for the left cheek assembly 40*a* of the bit 10*a* of FIG. 3.

Figure 5:
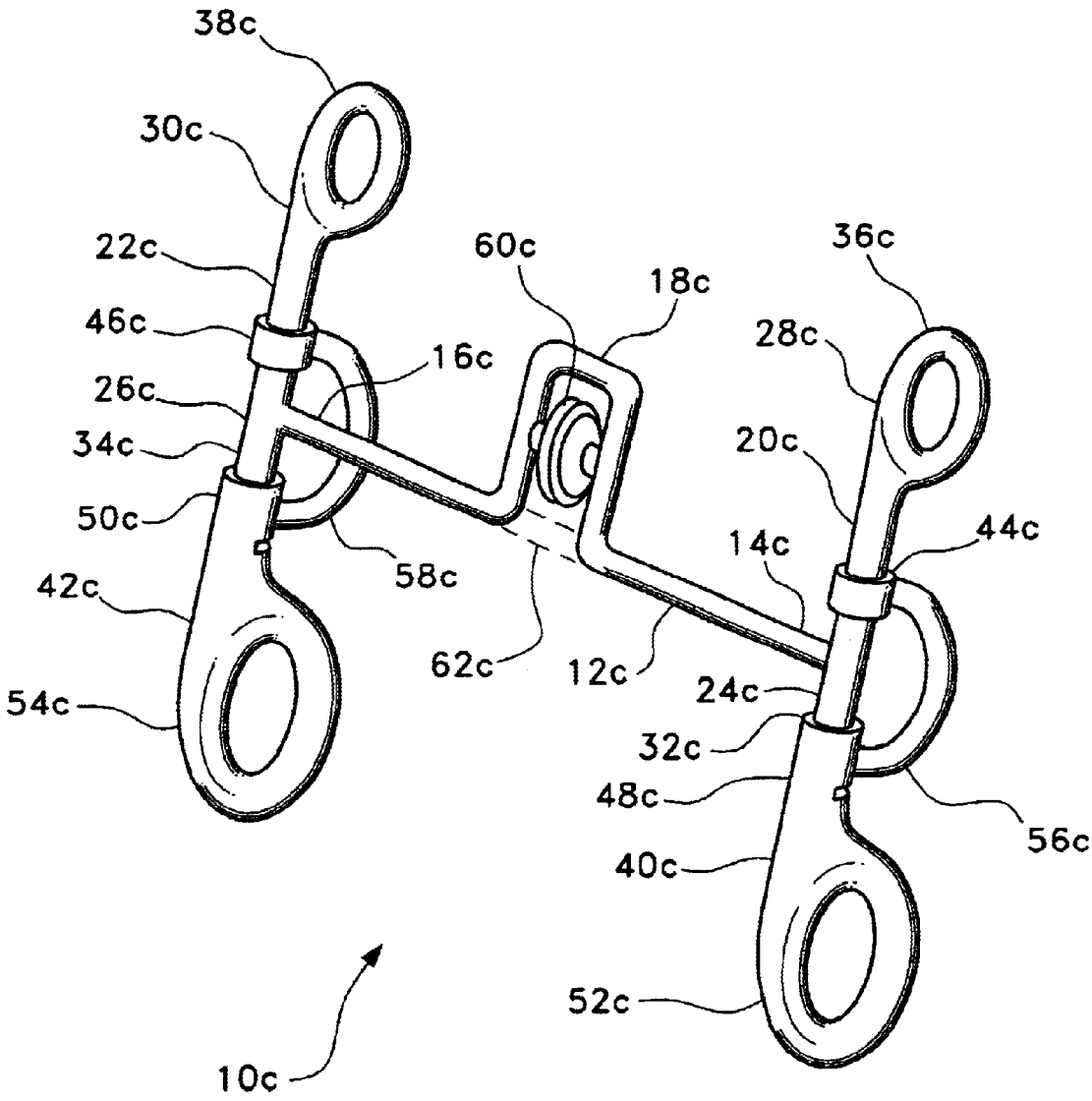
FIG. 5 is a front left side perspective view of yet another alternative embodiment of a bridle bit having a ported mouth bar and roller, and incorporating the swivel cheeks of the present invention.

FIG. 5 illustrates yet another embodiment of the present swivel cheek bridle bit, designated as bit 10*c*. The bit 10*c* has a general configuration similar to the bit 10 of FIGS. 1 and 2. Corresponding components are designated with the lower case sub character "c" for the bit 10*c* of FIG. 5. No detailed discussion is provided of structure and function for the bit 10*c* of FIG. 5 which is similar or identical to corresponding structure and function of the bit 10 of FIGS. 1 and 2, as it will be apparent that the discussion provided further above of such structure and function for the bit 10 of FIGS. 1 and 2 is also applicable to the bit 10*c* of FIG. 5.

However, the mouth bar 12*c* of the bit 10*c* of FIG. 5 differs from the mouth bars of the other bits of the present invention. The mouth bar 12*c* includes a port 18*c* formed generally centrally therein, with the port 18*c* including a roller 60*c* formed of copper or other material as desired. The port 18*c* may be open, as in the case of the bit 10 of FIGS. 1 and 2, or may alternatively be formed as a closed port by providing a closure member 62*c* (shown in broken lines) between the two mouth bar components to each side of the port 18*c*. Numerous other variations may be provided in the present swivel cheek bit invention, so long as they each include the swivel cheek configuration common to all of the embodiments disclosed herein, with the lower rein attachment ring and dees being swivelly attached to the remainder of the bit structure and the upper rings being rigidly and immovably affixed to the bit structure.

In conclusion, the present swivel cheeked bridle bit in its various embodiments provides a superior means of guiding and controlling a horse or other harness animal. The swivel action of the cheek portions of the present bit provide the advantages of bridle bits with swivel cheeks, but the fixed upper bridle attachment rings of the present bit avoid the twisting and turning of bridle straps attached thereto, which occurs with swivel cheek bits presently in use. This results in less irritation to the animal, and better compliance from the animal to commands from the rider. The present swivel cheek bit may be provided with or without the lower curb rein attachment rings, with reins being attached directly to the dees, if desired, particularly for training purposes. The advantages provided by the swiveling cheek portion and fixed upper bridle attachment ring portions of the present bit, are obtained regardless of the specific configuration of the remainder of the bit structure.

It is to be understood that the present invention is not limited to the embodiments described above, but encompasses any and all embodiments within the scope of the following claims.

I claim:

1. A swivel cheeked bridle bit, comprising:

a first purchase shank and a second purchase shank, each of the shanks having an upper end, a lower end, and a medial portion extending between the upper end and the lower end;

a mouth bar having a first end immovable affixed to the medial portion of the first shank and a second end immovably affixed to the medial portion of the second shank;

an upper ring extending from the upper end of each of the purchase shanks, and immovably affixed thereto;

a first cheek piece and a second cheek piece pivotally attached to the first and second purchase shanks, respectively, each of the cheek pieces having:

an upper purchase shank attachment passage pivotally attached to the purchase shank between the mouth bar and the upper ring; and a lower purchase shank attachment passage formed by a closed socket defined axially in an upper end of the cheek piece, the lower passage being pivotally and concentrically secured about the lower end of the purchase shank.

2. The swivel cheeked bridle bit according to claim 1, wherein each said cheek piece further includes a closed dee connecting a corresponding said upper and said lower purchase shank attachment passage together.

3. The swivel cheeked bridle bit according to claim 1, further including a lower ring extending from a lower end of each said cheek piece.

4. The swivel cheeked bridle bit according to claim 3, wherein:

the lower end of each said purchase shank defines a swivel axis; and each said lower ring is offset from each said swivel axis.

5. The swivel cheeked bridle bit according to claim 3, wherein said lower ring is larger than said upper ring.

6. The swivel cheeked bridle bit according to claim 1, wherein said mouth bar comprises a multiple piece snaffle.

7. The swivel cheeked bridle bit according to claim 1, wherein said mouth bar comprises a single, unitary component.

8. The swivel cheeked bridle bit according to claim 7, further including a hood extending from said mouth bar.

9. The swivel cheeked bridle bit according to claim 7, further including a tongue relief port formed in said mouth bar.

10. The swivel cheeked bridle bit according to claim 9, further including a roller disposed across said tongue relief port of said mouth bar.

11. A swivel cheeked bridle bit, comprising:

a first purchase shank and a second purchase shank, each of the shanks having an upper end, a lower end, and a medial portion extending between the upper end and the lower end;

a mouth bar having a first end immovable affixed to the medial portion of the first shank and a second end immovably affixed to the medial portion of the second shank;

an upper ring extending from the upper end of each of the purchase shanks, and immovably affixed thereto;

a first cheek piece and a second cheek piece pivotally attached to the first and second purchase shanks, respectively, each of the cheek pieces having:

an upper purchase shank attachment passage pivotally attached to the purchase shank between the mouth bar and the upper ring; and a lower purchase shank attachment passage pivotally about the lower end of the purchase shank; and a first dee and a second dee connected between the upper and lower purchase shank attachment passages of the first and second cheek pieces, respectively, whereby the dees and the cheek pieces swivel about the purchase shanks.

12. The swivel cheeked bridle bit according to claim 11, wherein each said lower purchase shank attachment passage comprises a closed socket secured concentrically and pivotally about the lower end of the corresponding said purchase shank.

13. The swivel cheeked bridle bit according to claim 11, further including a closed ring extending from the lower end of each said cheek piece.

14. The swivel cheeked bridle bit according to claim 13, wherein:

the lower end of each said purchase shank defines a swivel axis; and each said lower ring is offset from each said swivel axis.

15. The swivel cheeked bridle bit according to claim 13, wherein said lower ring is larger than said upper ring.

16. The swivel cheeked bridle bit according to claim 11, wherein said mouth bar comprises a multiple piece snaffle.

17. The swivel cheeked bridle bit according to claim 11, wherein said mouth bar comprises a single, unitary component.

18. The swivel cheeked bridle bit according to claim 17, further including a hood extending from said mouth bar.

19. The swivel cheeked bridle bit according to claim 17, further including a tongue relief port formed in said mouth bar.

20. The swivel cheeked bridle bit according to claim 19, further including a roller disposed across said tongue relief port of said mouth bar.

* * * * *